US008287089B2

(12) United States Patent
Kimura et al.

(10) Patent No.: US 8,287,089 B2
(45) Date of Patent: Oct. 16, 2012

(54) LIQUID EJECTION HEAD AND PRINTING APPARATUS

(75) Inventors: Yumi Kimura, Yokohama (JP); Ken Tsuchii, Sagamihara (JP); Hiroshi Arimizu, Kawasaki (JP); Shinji Kishikawa, Yokohama (JP); Arihito Miyakoshi, Tokyo (JP); Nobuhito Yamaguchi, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 295 days.

(21) Appl. No.: 12/638,310

(22) Filed: Dec. 15, 2009

(65) Prior Publication Data

US 2010/0156988 A1 Jun. 24, 2010

(30) Foreign Application Priority Data

Dec. 19, 2008 (JP) ..... 2008-323735
Nov. 9, 2009 (JP) ..... 2009-256144

(51) Int. Cl.
*B41J 2/145* (2006.01)
*B41J 2/15* (2006.01)

(52) U.S. Cl. ..... 347/40; 347/67; 347/77

(58) Field of Classification Search ..... 347/40, 347/42, 43, 67, 77, 82
See application file for complete search history.

(56) References Cited

U.S. PATENT DOCUMENTS

| | | | | |
|---|---|---|---|---|
| 6,132,028 | A * | 10/2000 | Su et al. | 347/47 |
| 6,151,045 | A * | 11/2000 | Beach et al. | 347/45 |
| 6,719,398 | B1 | 4/2004 | McElfresh et al. | |
| 6,746,108 | B1 * | 6/2004 | Jeanmaire | 347/82 |
| 6,824,248 | B2 | 11/2004 | Tsuchii | |
| 6,976,748 | B2 | 12/2005 | Yabe et al. | |
| 6,997,538 | B1 | 2/2006 | Kawamura et al. | |
| 2007/0035580 | A1 | 2/2007 | Ide et al. | |

* cited by examiner

*Primary Examiner* — Thinh Nguyen
(74) *Attorney, Agent, or Firm* — Fitzpatrick, Cella, Harper & Scinto

(57) ABSTRACT

A print head is provided in which influence on ink to be ejected from an ejection port by an air flow generated by ink previously ejected from the ejection port is suppressed evenly for respective ejection ports in the print head. A print head has an ejection port for ejecting ink. On an ejection port forming face formed with the ejection port, a projection projecting from the ejection port forming face is formed. The projection is arranged at a position where the distance from a center of the ejection port is within the maximum of a diameter of a vortex core of a vortex that is formed when liquid droplets are ejected in the case without a projection.

19 Claims, 19 Drawing Sheets

LIQUID EJECTION HEAD AND PRINTING APPARATUS

BACKGROUND OF THE INVENTION

1. Field of the Invention

The present invention relates to a liquid ejection head that ejects liquid droplets from an ejection port and makes the liquid droplets impact on a print medium and a printing apparatus including the liquid ejection head.

2. Description of the Related Art

At present, higher-speed and higher-image quality printing has been demanded for an ink-jet printing apparatus. As means for enabling higher-speed printing in the ink-jet printing apparatus, a reduction in the number of scanning times (number of passes) by a print head and an increase in scanning speed by the print head, etc., can be mentioned.

However, when these means for enabling higher-speed printing are adopted, this is accompanied by an increase in ejection frequency by the print head, so that the flow of air that is generated in a region between the print head and a print medium by ink ejected from the print head is significantly intensified.

As a result, under the influence of an air flow generated by the ink ejected from each ejection port row, ink droplets ejected subsequently are caught up in the air flow, which generates a density unevenness called "wind ripple". This creates the possibility that the quality of a printed image may not be maintained high. Moreover, in recent years, with the miniaturization of liquid droplets for an improvement in the quality of a printed image, the influence of wind ripple on an image has been further increased.

As methods for solving the above-mentioned problems, there are provided ink-jet printing apparatuses disclosed in U.S. Pat. No. 6,997,538 and U.S. Pat. No. 6,719,398.

U.S. Pat. No. 6,997,538 proposes an ink-jet printing apparatus for which, as shown in FIG. 18, air is blown in a direction orthogonal to a direction in which the ejection port row of a print head extends. Meanwhile, U.S. Pat. No. 6,719,398 discloses an ink-jet printing apparatus for which, as shown in FIG. 19A to FIG. 19C, air is blown in along a direction in which the ejection port row extends. By thus blowing air to the ejection port row, the influence of an air flow to be generated by an ink ejection is suppressed small.

However, for the ink-jet printing apparatus disclosed in U.S. Pat. No. 6,997,538, when a plurality of ejection port rows are formed in a direction orthogonal to a direction in which the ejection port rows extend, it is difficult to uniformly blow air to the respective ejection ports in the print head. An ejection port row located in the vicinity of a gas jet port to blow out air to an ejection port row and an ejection port row located at a position distant from the gas jet port are different in the amount of air reaching thereto. Accordingly, when the amount of air to be blown in is tailored to an ejection port row at a position close to the gas jet port, an ejection port row located at a part distant from the gas jet port can possibly be deficient in air flow. Thus, it is difficult to suppress, for all ejection ports in the print head, the influence of an air flow to be generated by the ink being ejected.

Moreover, in the ink-jet printing apparatus disclosed in U.S. Pat. No. 6,719,398, an ejection port located at a position close to an end portion of a ejection port row close to the gas jet port and an ejection port located at a position close to the center of the ejection port row are likewise different in the amount of air reaching thereto. Also in the ink-jet printing apparatus disclosed in U.S. Pat. No. 6,719,398, it is difficult to uniformly blow in air to all ejection ports in the print head.

SUMMARY OF THE INVENTION

In view of the circumstances mentioned above, it is therefore an object of the present invention to provide a liquid ejection head of which, an influence on a liquid to be ejected subsequently by an air flow to be generated by a liquid to be ejected from an ejection port is suppressed evenly for respective ejection ports in the liquid ejection head. It is also an object of the present invention to provide a printing apparatus including the liquid ejection head.

According to a first aspect of the present invention, there is provided a liquid ejection head: comprising an ejection port for ejecting a liquid, wherein a projection projecting from an ejection port forming face where the ejection port is formed is arranged, wherein the projection is arranged at a position where a distance from a center of the ejection port is within a maximum of a diameter of a vortex core of a vortex that is formed when liquid droplets are ejected in a case without the projection.

According to the present invention, by a projection formed along an ejection port row being formed on an ejection port forming face of a liquid ejection head, the influence on liquid droplets for printing that is exerted by an air flow to be generated by a liquid to be ejected can be suppressed small for ejection ports in the liquid ejection head. Accordingly, the quality of an image to be obtained by printing can be maintained high.

Further features of the present invention will become apparent from the following description of exemplary embodiments (with reference to the attached drawings).

DESCRIPTION OF THE EMBODIMENTS

Hereinafter, particular embodiments of the present invention will be described in detail with reference to the drawings.

First Embodiment

First, description will be given of a configuration of a print head 100 serving as a liquid ejection head according to a first embodiment of the present invention.

Figure 1:
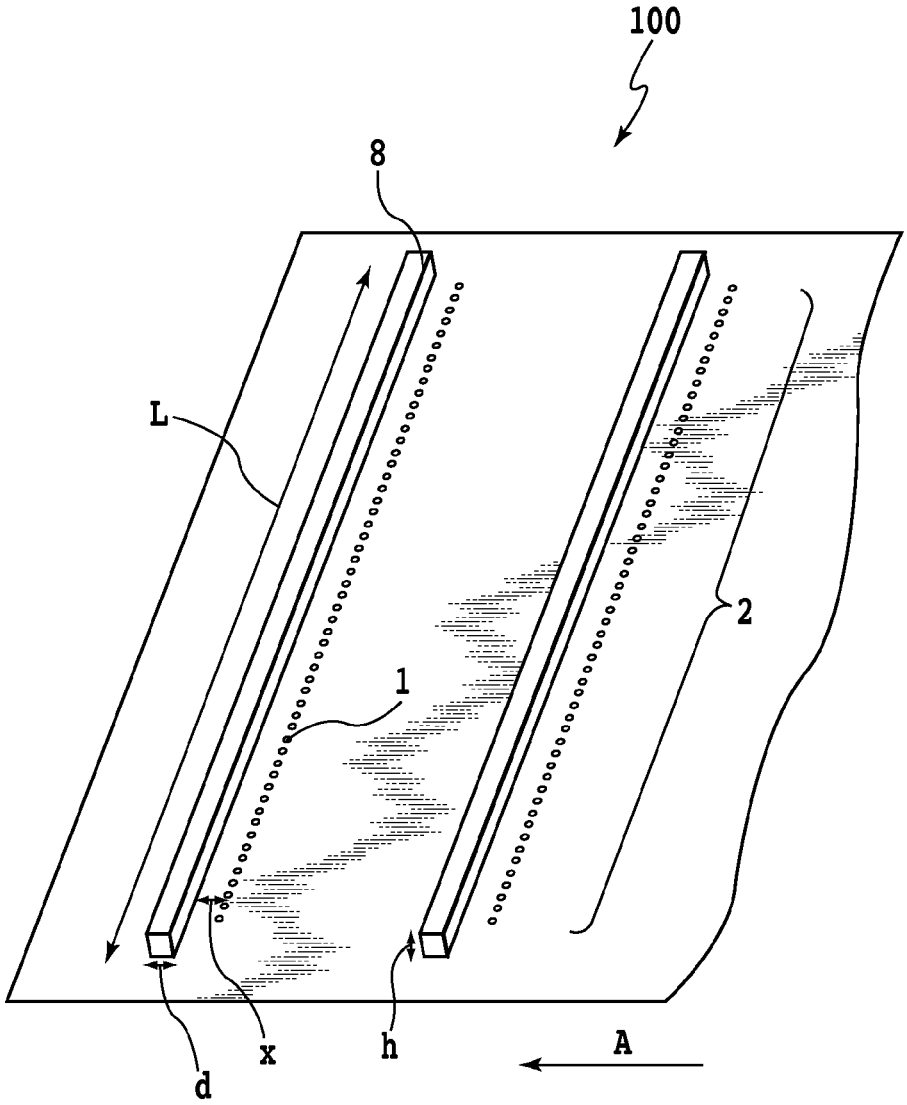
FIG. 1 is a perspective view of a print head according to a first embodiment of the present invention.

As shown in FIG. 1, an ejection port 1 ejecting ink as a liquid is formed in the print head 100 of the present embodiment. A plurality of ejection ports 1 are arranged to form an ejection port row 2 in the print head 100 of the present embodiment.

Figure 2:
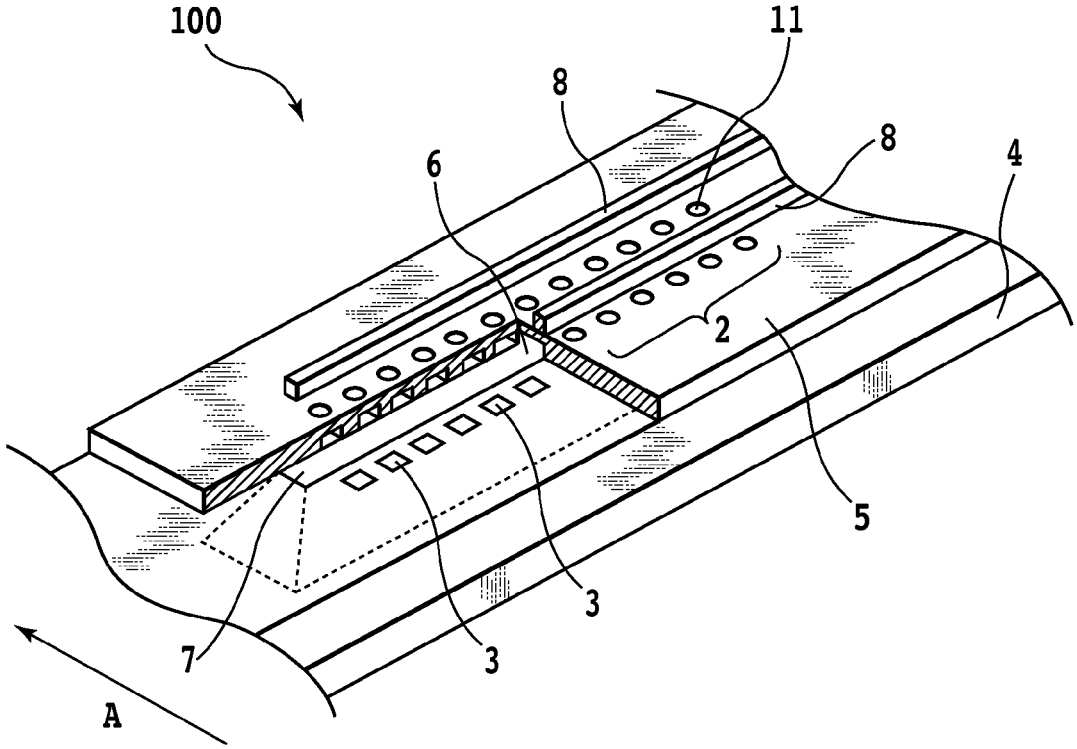
FIG. 2 is a perspective view schematically showing the print head of FIG. 1 partially broken away.

FIG. 2 is a perspective view schematically showing the print head 100 of the present embodiment, partially broken away. The print head 100 of the present embodiment comprises a substrate 4 arranged with an electrothermal transducing element 3 and an orifice plate 5 formed with the ejection port row 2. On the substrate 4, a semiconductor element such as a switching transistor for selectively driving the electrothermal transducing elements 3 is arranged. And, as a result of the substrate 4 and the orifice plate 5 being joined to each other, a liquid chamber 6 capable of storing ink as a liquid is defined therebetween. Moreover, in the substrate 4, an ink supply port 7 that supplies ink to the print head 100 is formed so as to communicate with the liquid chamber 6. Ink is supplied to the print head 100 from an ink tank (not shown) via the ink supply port 7.

The ink tank may be formed integrally with the print head 100 and formed as an ink-jet cartridge, or may be formed separately from the print head 100 and arranged inside a printing apparatus body. Alternatively, the ink tank may be attached to the print head 100 so as to be detachable from the print head 100. As a printing element to energize the ink in the liquid chamber 6 in order to eject liquid droplets, the electrothermal transducing element serving as a heater is used in the present embodiment; however, the present invention is not limited thereto, and another printing element such as a piezoelectric element may be used as a printing element.

As shown in FIG. 1 and FIG. 2, in the print head 100 of the present embodiment, a projection 8 extending in parallel in a direction in which the ejection port row extends and projecting from an ejection port forming face of an orifice plate 5 is formed on the ejection port forming face. When the print head of the present embodiment is of a serial scan type that performs scanning, and printing is performed in only either forward or backward scanning, the projection 8 is, for the ejection port row 2, located at a front side in a print head scanning direction A being a direction in which the print head 100 performs scanning.

The projection 8 is preferably formed with a length L, in the direction parallel to a direction in which the ejection port row 2 extends, at least equal to or more than the length of the ejection port row 2 so as to cover the ejection port row 2 in the direction in which the ejection port row 2 extends. Because the projection 8, as will be described later, is formed for the purpose of suppressing vortices that liquid droplets ejected from the ejection ports 1 generate, it is therefore desirably formed with such a length as to cover a range in which vortices occur. More specifically, the projection 8 desirably has a length of covering in the direction in which the ejection port row 2 extends, and desirably, a length equal to the length of the ejection port row 2 plus 1 mm. Accordingly, the projection 8 may extend so as to greatly exceed the length of the ejection port row 2, as long as the projection 8 extends in a covering manner in the direction extending along the ejection port row 2. There is no significant change in the effect to be provided by the projection 8 at this time. It is thus preferable that the length of the projection 8 is longer than that of the ejection port row by 1 mm or more.

Figure 3:
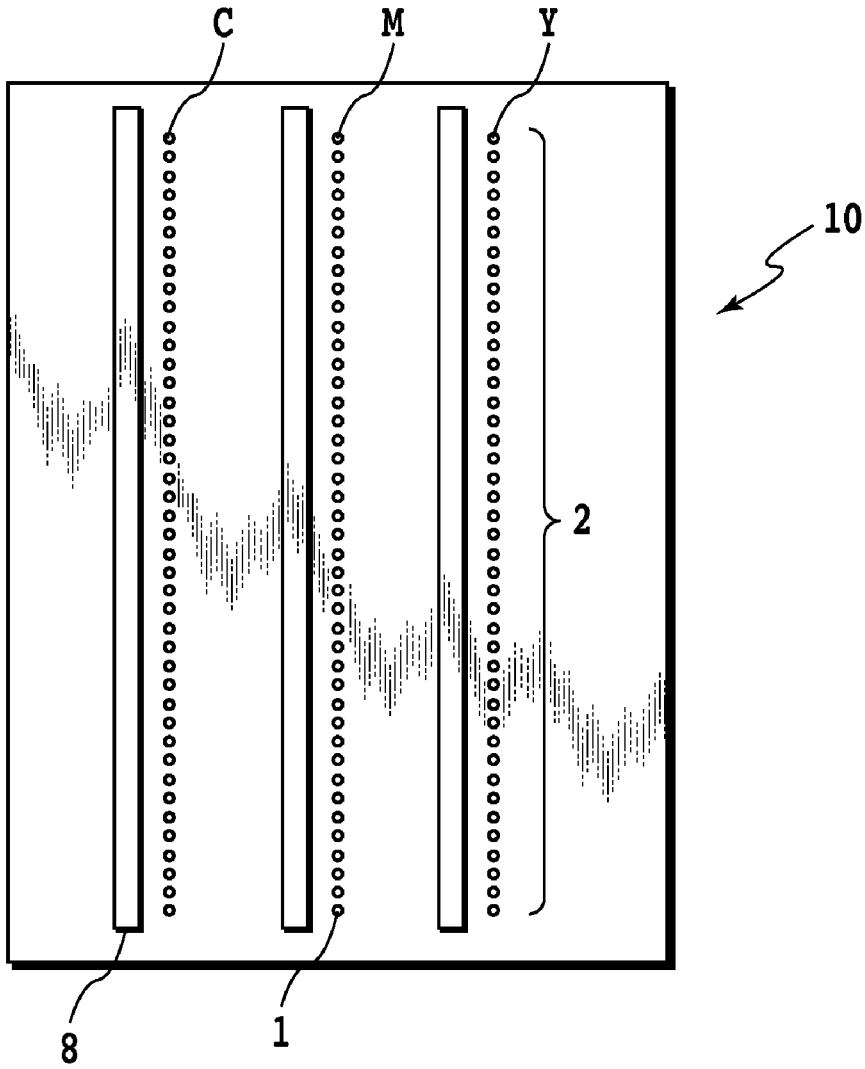
FIG. 3 is a plan view showing the whole of the print head of FIG. 1.

In the present embodiment, the print head 100 is configured so as to be relatively movable with respect to a print medium. Particularly, in the print head 100 of the present embodiment, one-way printing in only either forward or backward scanning is performed. A configuration of the print head 100 of the present embodiment that performs one-way printing is shown in FIG. 3. In FIG. 3, one ejection port row 2 is arranged for each one color of cyan (C), magenta (M), and yellow (Y) on one print head 100. By thus forming the print head so that only one ejection port row exists for each color, the print head can be downsized because of the small number of ejection port rows. This allows reducing the cost in manufacturing of the print head. If the print head 100 is adopted as a print head for two-way printing to perform printing in both forward and backward scanning, the impacting order of each color is different between the forward and backward scanning, so that a color unevenness is likely to occur between the forward and backward scanning of the print head. Accordingly, if a print head is formed so that one ejection port row is simply formed for one color, the print head is used more often in one-way printing than two-way printing.

And, in the print head 100 of the present embodiment, the projection 8 is, for the ejection port row 2, located at the front in a relative moving direction with respect to a print medium when performing printing. More specifically, in the print head 100 of the present embodiment, when performing printing, the print head 100 scans in the direction in which the projection 8 is arranged for the ejection port row 2.

When printing is performed, ink is stored inside the liquid chamber 6, and thermal energy is imparted to the ink by the electrothermal transducing element 3, so that the ink is ejected from the ejection ports 1. The print head 100 of the present embodiment is mounted on a carriage of a printing apparatus, and scanning is performed in a width direction of a print medium for which printing is performed, while the ink is ejected at a predetermined position to perform printing.

At this time, ejected ink droplets drag ambient air while flying toward the print medium. Accordingly, a flow of air is caused in a direction where liquid droplets are ejected, and this flow hits a surface of the print medium to curl up. As a result, a vortex is generated in a region between the print head and the print medium. Then, when this vortex is intensified to a certain level or more, the flying liquid droplets are also carried away in the ejection port row extending direction to lower the impacting accuracy of liquid droplets.

Moreover, because so-called satellites that are liquid droplets flying following a main droplet that flies at the head of the ink to be ejected are smaller in volume than the main droplet, these are easily affected by air flow. Accordingly, when an air flow is generated between the print head and the print medium, the air flow exerts a great influence on, particularly, the impacting accuracy of satellites of the ink to be ejected.

Here, in the present embodiment, because the print head 100 has the projection 8 on the ejection port forming face of the orifice plate 5, the projection acts as a resistance against a vortex generated by ejected liquid droplets to weaken and make the vortex small. Maintaining thereby the vortex to a certain level or less of intensity and size prevents the ink droplets from being carried away, so that the impacting accuracy is maintained high.

Moreover, in the present embodiment, the projection 8 is, for the ejection port row 2, formed at the front in the scanning direction when performing printing. That is, when performing printing, the print head scans in the direction in which the projection is arranged for the ejection port row. Accordingly, an air flow to be generated by ejecting the ink is effectively suppressed.

Figure 4:
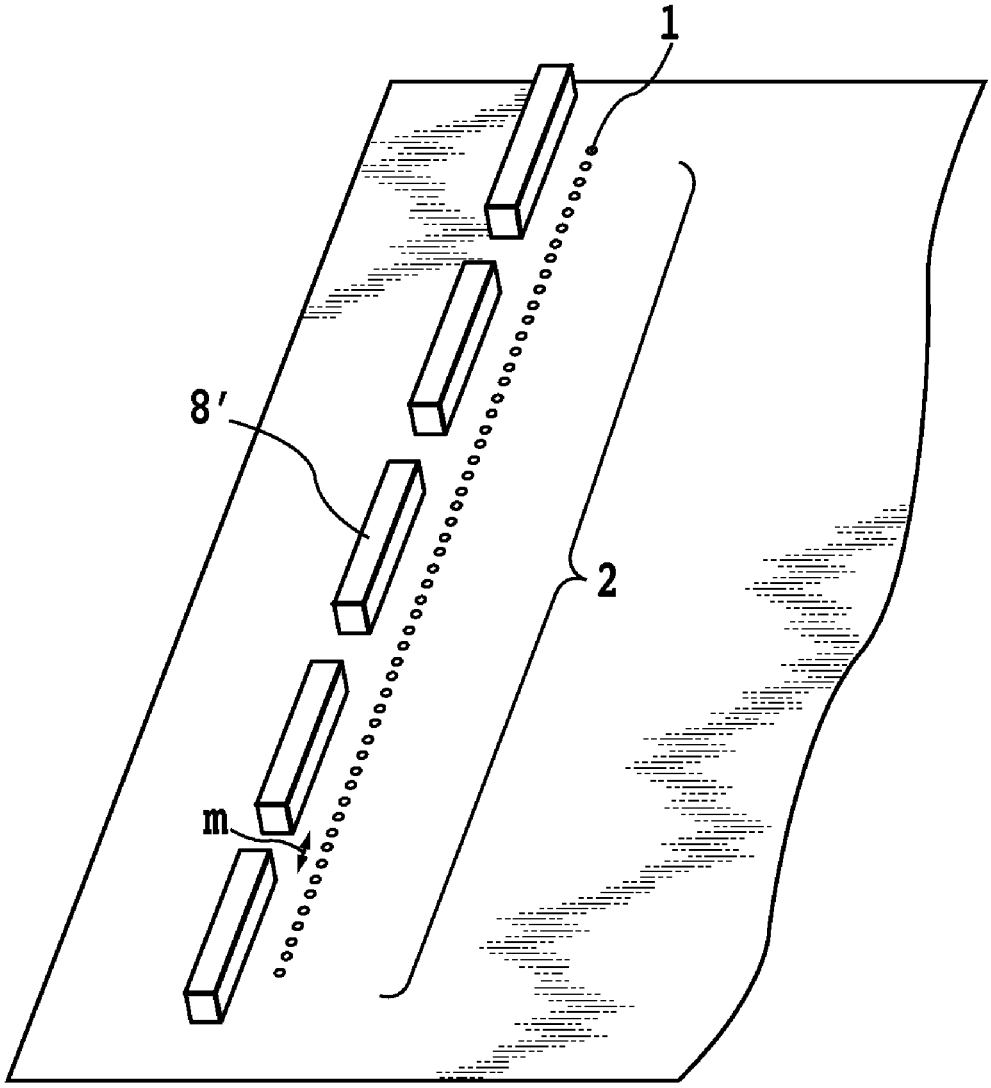
FIG. 4 is a perspective view showing a modification of the print head of FIG. 1.

Also, as shown in FIG. 4, the projection 8 may be projections 8' formed discontinuously in the ejection port row direction that the ejection port row extends. In this case, the projections 8' desirably have an interval "m" of 20 μm or less therebetween. Provision of such an interval allows retaining ink overflowed on an ejection port face by a capillary force between the projections, so that a drop onto the surface of the print medium can be prevented. If the interval m is large, the effect of being a resistance against a vortex tends to be weak. That is, a large interval m produces an uneven vortex intensity distribution in the ejection port row direction, such that a vortex is large in a part of the interval m and a vortex is small in other parts, which can cause a decline in image quality. Thus, the distance m is preferably 20 μm or less because, because if the interval m is formed large, a desirable effect can possibly no longer be expected for this.

Figure 5:
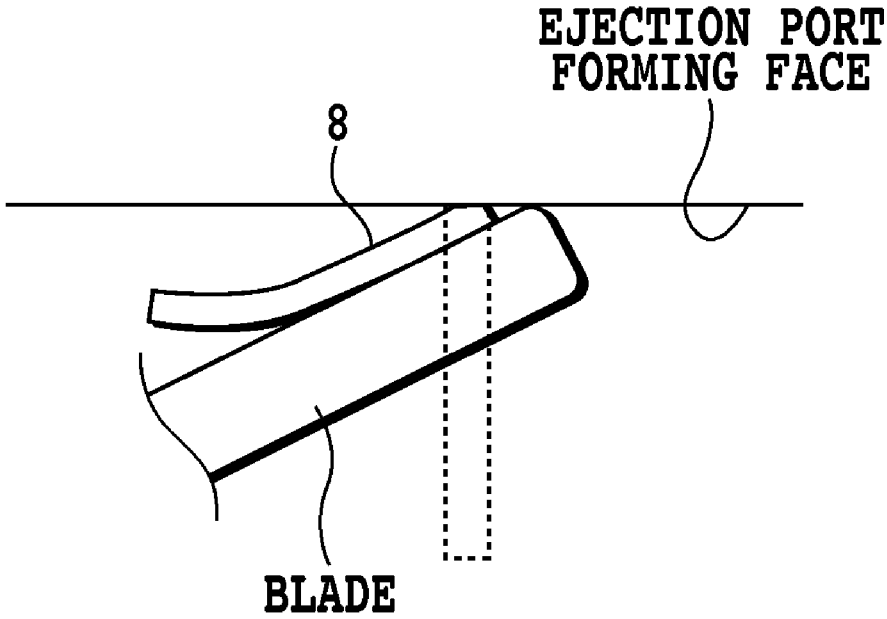
FIG. 5 is a side view of the print head of FIG. 1 when an ejection port forming face is being wiped by a blade.

In addition, the material for forming the projection is not particularly limited. However, when wiping the ejection port face to clean the ejection port face, it is required that the projection does not become an obstacle. Moreover, when the projection causes friction with the print medium, it is required to prevent causing displacement of the print medium. Therefore, the projection is desirably formed of a material that is flexible to such an extent as not to fall with scanning of the print head. When the projection is formed of a flexible material, in the case of wiping of the ejection port face by a blade or the like as shown in FIG. 5, possible damage to the blade by the projection 8 is reduced. Moreover, in the case of friction between the projection 8 and the print medium, the projection 8 itself deforms to thereby prevent displacement of the print medium from occurring.

Hereinafter, the effect of the projection will be described in greater detail. A print head to be used in the following experimentation has a distance between the print head and a print medium of 1.25 mm, and the number in a row of ejection ports 1 in the ejection port row 2 is 256 and the density of the ejection ports in the ejection port row direction is 600 dpi. Moreover, the print head moves at 25 inch/s while performing scanning, and ejects 1.4 pl droplets with a frequency of 15 kHz. Conditions for printing to be performed as such will be hereinafter called standard printing conditions.

Figure 6:
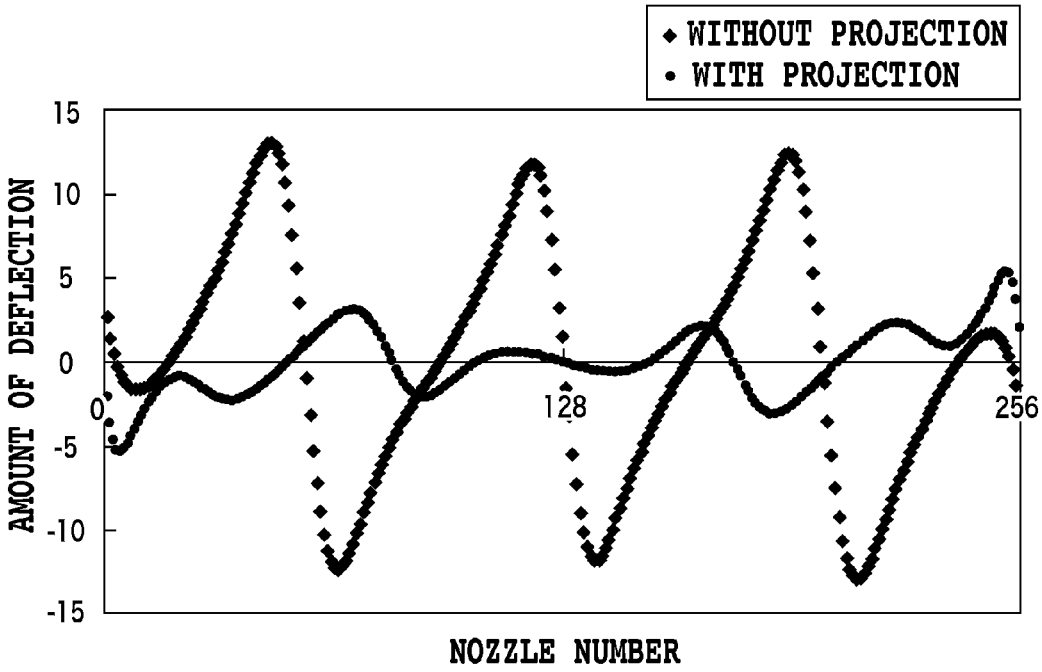
FIG. 6 is a graph showing the amounts of deflection of an ejected ink compared between when there is a projection and when there is not a projection, in the print head of FIG. 1.

FIG. 6 shows a graph showing the amounts of deflection of satellites when printing was performed with the standard printing conditions without a projection and when printing was performed according to the standard printing conditions with a projection provided at a position of 50 μm from an ejection port center. On a print head with the projection, a projection with a height "h" of 200 μm and a width "d" (a length "d" in the direction orthogonal to an ejection port row) of 127.2 μm is provided. Here, the amount of deflection means the amount of misalignment between an actual impacting position of ejected liquid droplets and a predetermined impacting position, in the direction in which an ejection port row extends. The predetermined impacting position is an impacting position when liquid droplets fly from an ejection port vertically to the ejection port face and linearly and impact thereon. The horizontal axis of the graph shows the ejection port number, for which ejection ports from one end to the other end of the ejection port row are numbered in order. However, the amount of deflection can also change due to factors other than the above-mentioned parameters with the standard printing conditions, such as, for example, the flying velocity and mass of liquid droplets, and therefore may possibly slightly deflect from the results in FIG. 6 even when printing is performed with the same conditions.

Comparing the printing result in the case without a projection and with the standard printing conditions and the printing result in the case with a projection with the standard printing conditions in the graph of FIG. 6, the printing result when a projection was provided indicates that the amount of deflection at impacting of the liquid droplets falls within a narrower range than that of the printing result in the case without a projection. It can be confirmed from the graph of FIG. 6 that the amount of deflection of the liquid droplets has been reduced by the provision of a projection on the print head.

Figure 7:
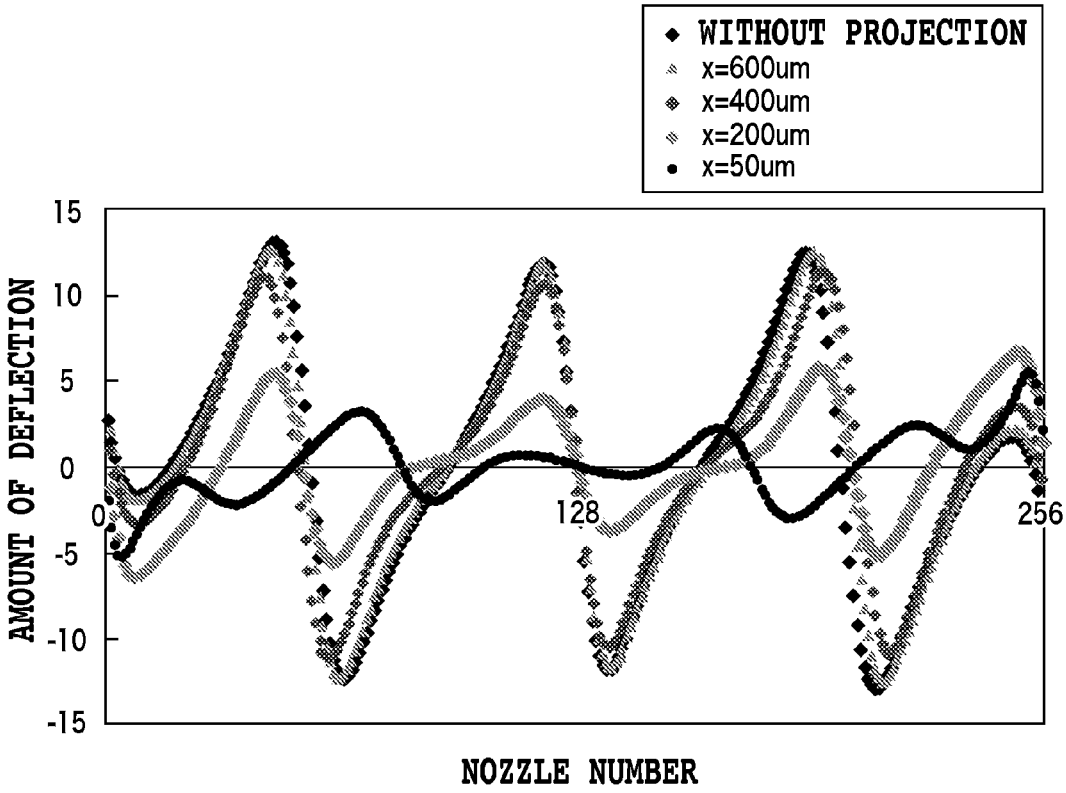
FIG. 7 is a graph showing the amounts of deflection of an ejected ink compared by changing the distance between a projection and the center of an ejection port, in the print head of FIG. 1.

Next, a preferred projection position will be described. In order to describe the projection position, description will be given of the relationship between the projection position and the amount of deflection of ejected liquid droplets, in the case that the height h of the projection is 200 μm and the width d thereof is 127.2 μm. In order to confirm the relationship between the projection position and the amount of deflection of ejected liquid droplets, the amounts of deflection of liquid droplets ejected from a print head without a projection and ejected from print heads each with a distance "x" from a projection to the ejection port center of 50 μm, 200 μm, 400 μm, or 600 μm are shown in the graph of FIG. 7, and the amounts of deflection are compared with each other. Here, x means the distance from a projection end on the ejection port side to the ejection port center.

As shown in FIG. 7, according to the graph, the amount of deflection has been reduced under the influence of a projection in a region of the position where the distance x from the projection to the ejection port center is less than 600 μm, and the amount of deflection has been clearly reduced at x=400 μm. Further, it can be confirmed that the amount of deflection of liquid droplets has been reduced to a 5 μm order, that is, an almost invisible level, at x=200 μm.

Figure 8A:
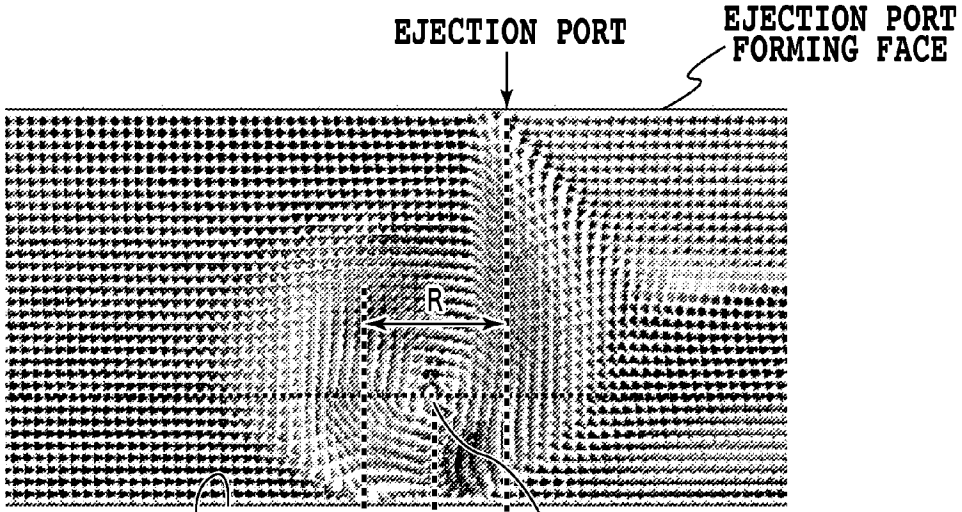
FIG. 8A is an explanatory view showing a flow field that is generated when ink is ejected in a print head without a projection.
Figure 8B:
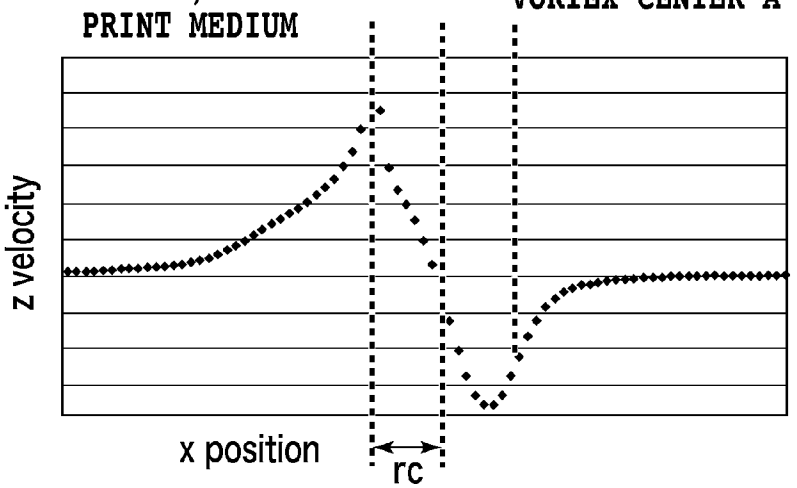
FIG. 8B is a graph showing a velocity component distribution in a head-print medium direction of an air flow at a height passing through a vortex center at that time.

Meanwhile, when liquid droplets are ejected between parallel plates such as between a print head and a print medium, air is dragged by a motion of the liquid droplets, so that a vortex as shown in FIG. 8A occurs between the print head and the print medium. FIG. 8A shows a direction of an air flow in the periphery of an ejection port in a region between the print head and the print medium when liquid droplets were ejected from the ejection port and a vortex occurred. This vortex is a Rankine vortex, and a diameter of vortex core R is determined from a velocity distribution. FIG. 8B shows a velocity component distribution in a head-print medium direction along a straight line passing through a vortex center in the region between the print head and the print medium.

Thus, in a region from a vortex center A to a position distant approximately R/2 from the vortex center A, the absolute value of velocity increases in proportion to the distance from the vortex center A. On the other hand, in a region outside the region from a vortex center A to a position distant approximately R/2 from the vortex center A, it can be confirmed that the absolute value of velocity reduces in inverse proportion to the distance from the vortex center A. The distance of approximately R/2 from the vortex center A at this time is referred to as a vortex core radius $r_c$.

Additionally, the diameters of vortex core of vortices due to ejection often have a distribution of varying size in the ejection port row direction, and therefore, the maximum value of a diameter of a vortex core will be herein referred to as a maximum of the diameter of the vortex core. With regard to the maximum of the diameter of the vortex core, those skilled in the art can measure or estimate its value by using PIV (Particle Image Velocimetry) and CFD (Computational Fluid Dynamics).

The maximum of the diameter of the vortex core depends also on the ejection velocity of liquid droplets ejected from the print head and a droplet formation and cannot therefore be unconditionally determined, but it is approximately 600 μm with the standard printing conditions without a projection. Accordingly, a distance x from the center of an ejection port to the end of a projection where an effect of improvement in deflection of liquid droplets due to an air flow just begins to appear and the maximum of the diameter of the vortex core of a vortex due to ejection are almost coincident. More specifically, if a projection is formed on the print head with the standard printing conditions, by providing the projection at a position roughly within the maximum of the diameter of the vortex core from the center position of an ejection port, a vortex can be suppressed to reduce deflection of liquid droplets due to an air flow. Thus, the projection 8 of the present embodiment, as a result of being arranged at a position where the distance from the center of the ejection port 1 is within the maximum of the diameter of the vortex core of a vortex to be formed when ink is ejected in the case without a projection, allows suppressing an air flow to be generated by the ink being ejected small. Accordingly, with the standard printing conditions, the projection 8 is preferably arranged at a position within 600 μm from the center of the ejection port. Moreover, the projection 8 is more preferably arranged at a position within 400 μm from the center of the ejection port, and still more preferably arranged at a position within 200 μm from the center of the ejection port.

Here, when the vortex is increased in size with an increase in the ejection volume, frequency, and ejection port density etc., the diameter of the vortex core is also increased, and therefore, the diameter of the vortex core provides a good measure of the vortex size. This applies even in the case of ejecting with arbitrary printing conditions as well, without limitation to the case of ejecting with the standard printing conditions. Moreover, it is apparent that a vortex extends up to a part distant from the ejection port row if the vortex is large, and the vortex is affected even when the projection position is distant from the ejection port row, and conversely, if a vortex is small, it is unlikely that the vortex is affected unless the position of the projection is close to the ejection port position. Hence, the diameter of the vortex core provides a measure of the projection position effective for air flow control.

Figure 9:
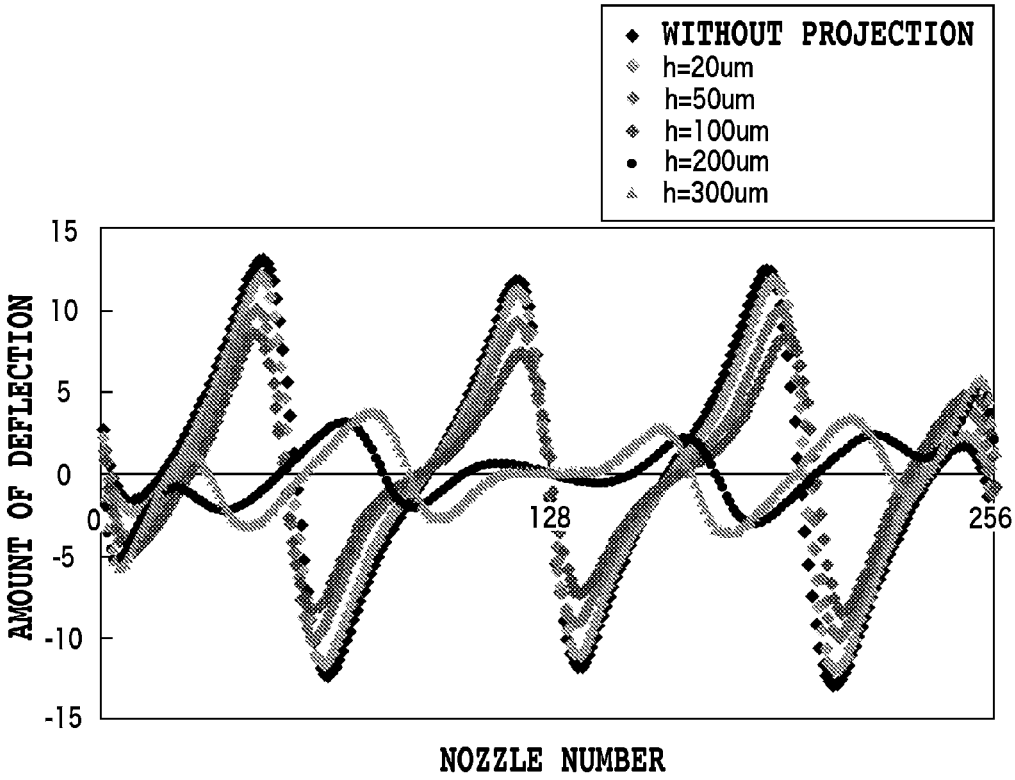
FIG. 9 is a graph showing the amounts of deflection of an ejected ink compared by changing the height of a projection, in the print head of FIG. 1.

Next, a preferred projection height h will be described. In order to describe the preferred height h of a projection, description will be given of the relationship between the projection height h and deflection due to an air flow, by using a print head formed with no projection and print heads each formed with a projection having a distance x from the ejection port center to the end of a projection on the ejection port side of 50 μm and a width d of 127.2 μm. FIG. 9 shows a graph of a comparison of the amounts of deflection of ejected liquid droplets when there was not a projection on a print head with the standard printing conditions and when a projection was provided on a print head and the projection height was provided as 20 μm, 50 μm, 100 μm, 200 μm, or 300 μm. It can be confirmed from FIG. 9 that the amount of deflection of ejected liquid droplets has reduced as the projection height has increased. Thus, it is confirmed that providing a projection with a height of a 20 to 50 μm order or more has a significant effect on an improvement in deflection due to an air flow of ejected liquid droplets.

Moreover, it can be understood that the maximum amount of deflection of the ejected liquid droplets has reduced to a 10 μm order when the projection height is 50 μm. Particularly, the value of the maximum amount of deflection of 10 μm for 1.4 pl of satellites is a reference value as to whether a density unevenness is sensed or not in the case of observation by the naked eye from a position approximately 30 cm from the surface of the print medium. Accordingly, this indicates that, when a projection with a height h of 50 μm is provided, a density unevenness can be sensed in the case of confirmation at close range or by magnification, however, the deflection is lessened to such a minute level in ordinary use.

Subsequently, in terms of the amount of deflection of liquid droplets ejected from the print head with a projection height of 200 μm, it can be confirmed that the amount of deflection has considerably reduced as compared with that in the case of 100 μm or less. By thus providing a projection with a height of a 200 μm order or more, wind ripple due to a density unevenness is dramatically improved in actual printing. If a projection with a height of this order is provided, a density unevenness can no longer be sensed even when an image is observed more closely. Thus, when printing is performed with the standard recoding conditions, it is preferable that the projection height is 20 mm or more, and further, it is more preferable that the projection height is 50 μm or more. Moreover, it is still more preferable that the height of the projection is 200 μm or more.

Figure 10:
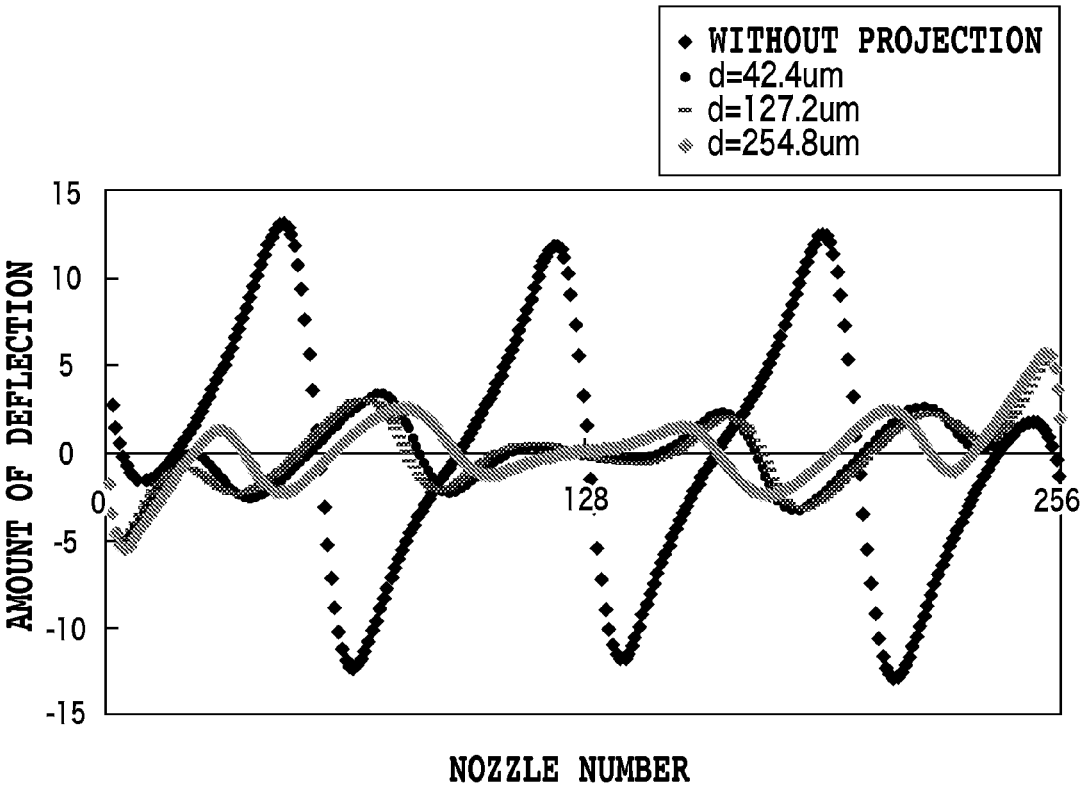
FIG. 10 is a graph showing the amounts of deflection of an ejected ink compared by changing the width of a projection, in the print head of FIG. 1.

Next, the width d of a projection in a direction orthogonal to a direction in which the ejection port row extends will be described. In order to describe the relationship between the projection width and deflection of liquid droplets due to an air flow, description will be given of the relationship between the projection width d and a defection caused by an air flow, in a case that the distance x from the ejection port center to the projection end on the ejection port side is 50 μm and the projection height h is 200 μm. A graph of the amounts of deflection of liquid droplets ejected from a print head without a projection with the standard printing conditions and ejected from print heads each formed with a projection when the width d was provided as 42.4 μm, 127.2 μm, or 254.8 μm is shown in FIG. 10. It can be confirmed from the graph of FIG. 10 that, by forming a projection with a width of 42 μm or more on a print head, the image quality is enhanced almost regardless of the projection width d even when the projection width d is changed. More specifically, it can be said that, as long as a projection with a width of 42 μm or more is formed at the front in the scanning direction of an ejection port, the width has almost no influence on the image quality. Although the projections described in the foregoing are all rectangular projections, the same effects are obtained even when these have a columnar or polygonal pillar shape or the like. Moreover, although the projections described in the foregoing are the projection closely adheres to the ejection port forming face of the orifice plate 5 and no substantial gap exists therebetween, the present invention is not limited thereto. There may be, for example, a configuration that the projection contacts the ejection port forming face of the orifice plate only at both longitudinal end portions thereof and has a gap with the ejection port face in other portions thereof.

In the present invention, the print head 100 of the present invention is described in terms of when this is applied to a serial scan-type printing apparatus that performs scanning while printing. However, the print head 100 of the present invention may be applied to a so-called full line-type printing apparatus that, without scanning of a print head, performs printing by a long print head. In this case, by providing the projection, for the ejection port row, on an upstream side in a feed direction of the print medium, the influence of an air flow on liquid droplets is effectively suppressed.

Second Embodiment

Next, a second embodiment for carrying out the present invention will be described. A description of the same part of configuration as that of the first embodiment mentioned above will be omitted, and only a different part will be described.

Figure 11:
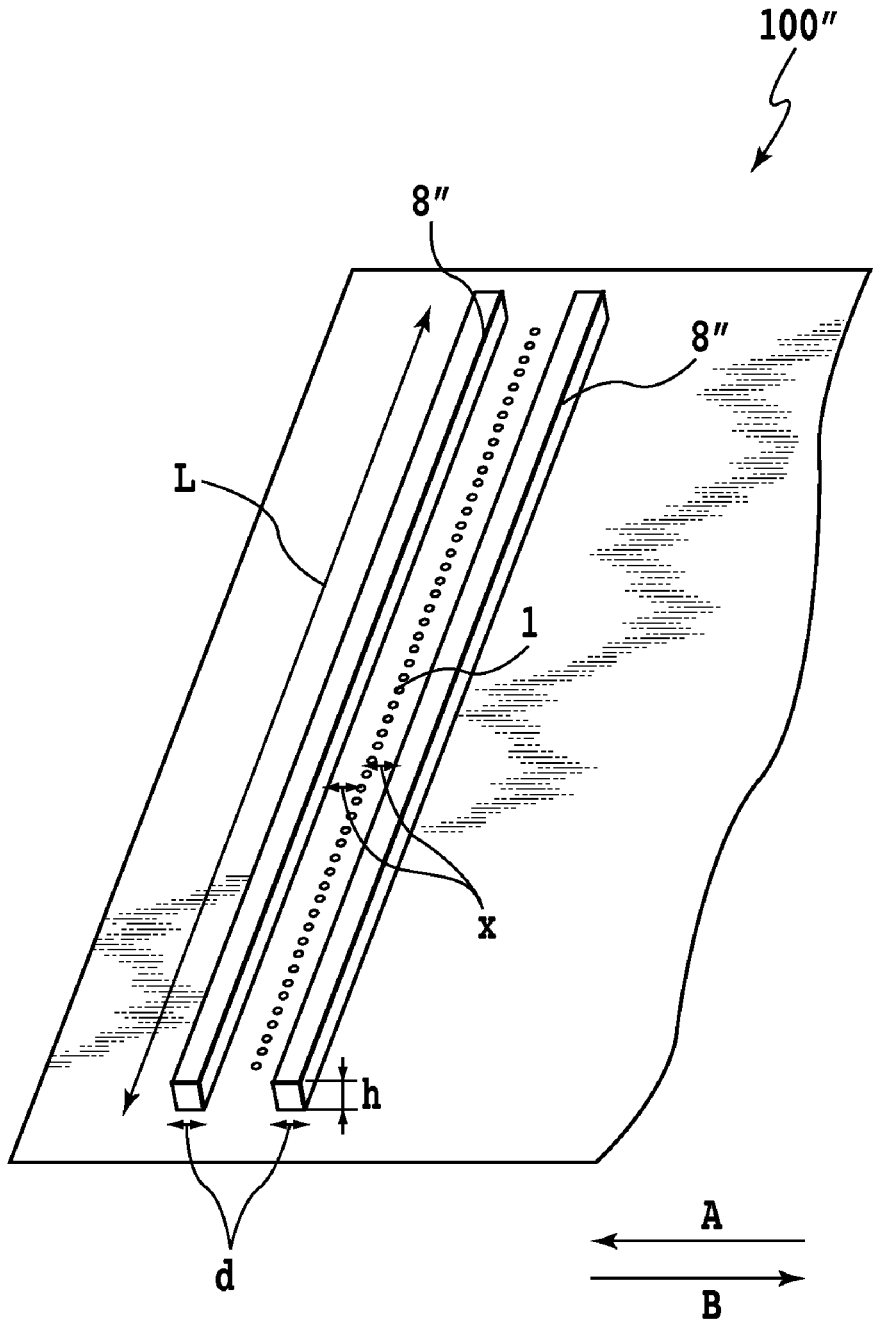
FIG. 11 is a perspective view of a print head according to a second embodiment of the present invention.

Although a basic configuration of the present embodiment is as described in the first embodiment, as shown in FIG. 11, a print head 100" of the present embodiment is different from the print head of the first embodiment in that a projection 8" is arranged at both the front and rear in a scanning direction of a ejection port row. The projection 8" in the present embodiment has a height h of 200 μm and a width d of 127.2 μm, and is provided at the front and rear in the scanning direction of an ejection port row 2, at each position where the distance x from the ejection port center to a projection end on the ejection port side is 50 μm. The dimensions and the distance from the ejection port center of the projection 8" do not always need to be the same between the front and rear in the scanning direction. However, in the case of two-way printing where the print head 100" of the present embodiment performs printing in both forward and backward scanning, it is desirable in order to obtain an even image quality both in the forward and backward scans that the above-mentioned conditions are substantially the same between the front and rear.

Figure 12:
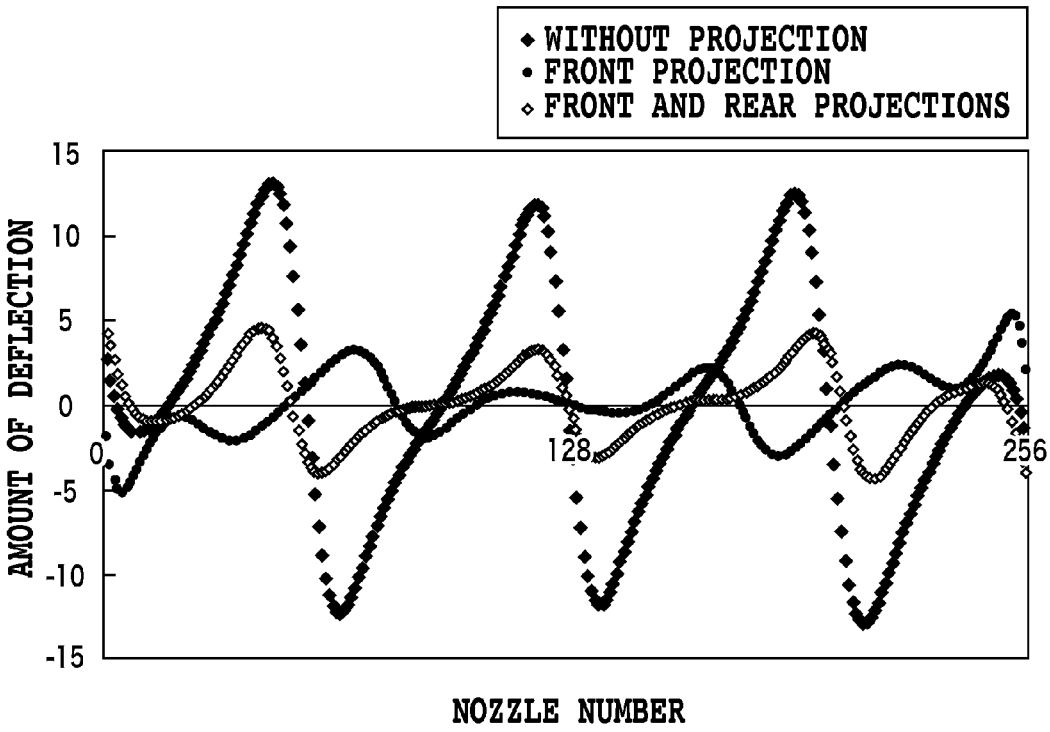
FIG. 12 is a graph showing the amounts of deflection of an ejected ink compared between when no projection is provided, when a projection is arranged only at the front in a scanning direction of an ejection port, and when a projection is arranged at both the front and rear in a scanning direction of an ejection port, in the print head.

The amount of deflection of liquid droplets to be ejected from the print head 100" where the projection 8" is arranged at both the front and rear in a scanning direction of an ejection port 1 will be described by using FIG. 12. FIG. 12 is a graph of a comparison of the amounts of deflection due to an air flow when there was not a projection with the standard printing conditions, when a projection is arranged only at the front in the scanning direction of an ejection port, and when a projection is arranged at each of the front and rear in the scanning direction of an ejection port. It can be confirmed from the results shown in FIG. 12 that the deflection due to an air flow is improved also when a projection is arranged at each of the front and rear.

Figure 13:
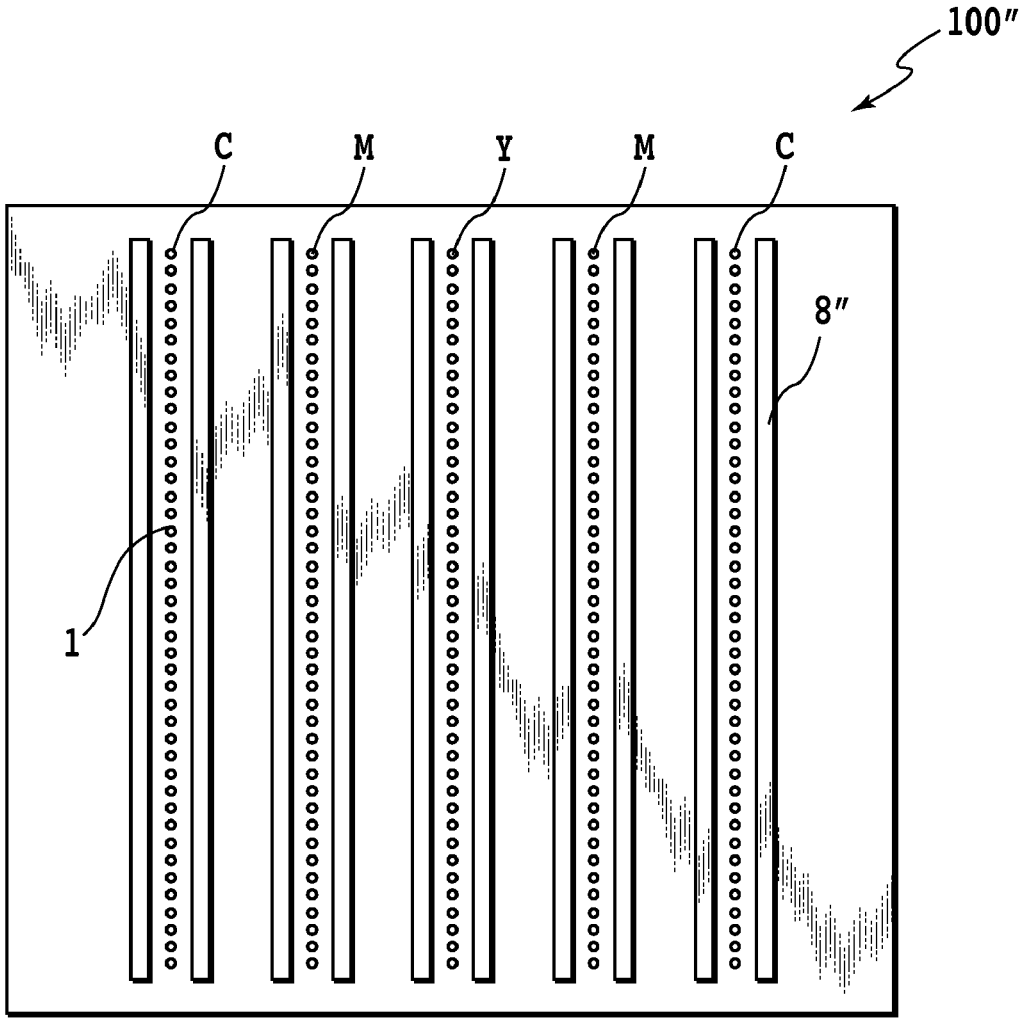
FIG. 13 is a plan view showing the whole of the print head of FIG. 11.

Although the present embodiment is not limited hereto, a print head where a projection is arranged at both the front and rear in the scanning direction of an ejection port is preferable in the case that a print head for two-way printing as shown in FIG. 13 is used. As shown in FIG. 13, ejection port rows in an order of cyan (C), magenta (M), yellow (Y), magenta (M), and cyan (C) are arranged in the scanning direction. Because the ejection port rows are arranged as such, the order of impacting onto the print medium surface is C, M, Y, M, and C irrespective of the forward or backward scanning direction of the head, so that unevenness of color to be caused by the color order does not occur. Therefore, the print head arranged with ejection port rows as such is suitable for two-way printing.

Moreover, when a print head performs two-way printing, printing is performed in both forward and backward directions of the print head. For this reason, when a projection is arranged only at either one of the front or rear of an ejection port, a state of the absence of a projection at the front in a scanning direction sometimes occurs in either scanning direction when performing printing. Accordingly, when two-way printing is performed, it is preferable to, as in the present embodiment, arrange the projection 8" at the front and rear in a relative moving direction with respect to a print medium, of the ejection port row 2. As a result of a projection being arranged at both the front and rear in the scanning direction of the ejection port 1 as such, when the print head scans in a forward direction A and a backward direction B of FIG. 11 and performs printing, the projection is located at the front in the scanning direction when the print head 100" moves in either direction to perform printing. Accordingly, an effect of a reduction in the amount of deflection due to ejected liquid droplets can be obtained in either case of scanning in the forward direction A and the backward direction B of the print head. Based on the above, according to the print head of the present embodiment, even when printing in both directions is performed for high-speed printing, adopting the print head as shown in FIG. 13 allows maintaining the quality of an image to be obtained by printing high.

Third Embodiment

Next, a third embodiment for carrying out the present invention will be described. A description of the same part of configuration as that of the first and second embodiments mentioned above will be omitted, and only a different part will be described.

Figure 14:
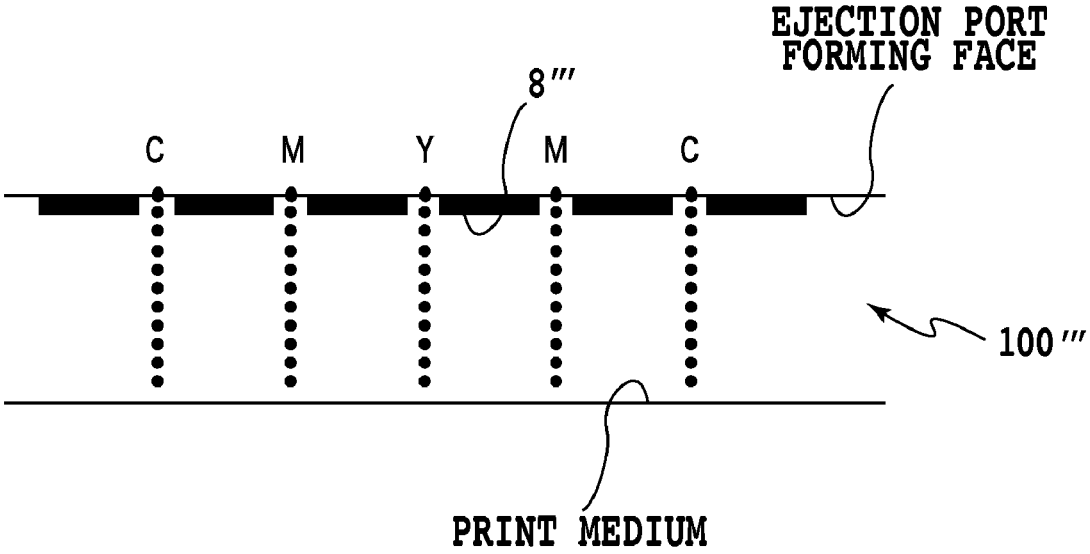
FIG. 14 is a side view of a print head according to a third embodiment of the present invention.

A print head 100'" of the present embodiment will be described by using FIG. 14. The print head 100'" to be described in the present embodiment is formed with an ejection port row 2 of each color of cyan (C), magenta (M), and yellow (Y). Projections 8'" each having a height of 20 μm or more are arranged between the ejection port rows 2. A distance x from the ejection port center to a projection end on the ejection port side of the projection 8'" is within the maximum of the diameter of the vortex core of a vortex that occurs in the case without a projection. In addition, the print head 100'" of the present embodiment is entirely filled in gaps between projections arranged at the front and rear in a scanning direction of an ejection port 1. In the present embodiment, the separate projections mutually adjacent in the second embodiment are formed of a single member. For this, the print head of the present embodiment is different from the print head of the second embodiment described above in that the projections 8'" occupy a region other than the ejection ports.

The projections 8'", even with such a configuration, allow obtaining the same effect of a reduction in the amount of deflection of liquid droplets due to an air flow as that of the configuration described in the second embodiment. Further, the printhead 100'" of the present embodiment facilitates wiping because of the smaller number of projections than that, as with the projections 8" of the second embodiment, when two rows of separate projections 8" are formed between the ejection port rows.

Moreover, when a gap is formed between the projections 8" as in the second embodiment, there is a possibility that ink may pool in the gap, and the pooled ink may be accumulated to finally drop on a print medium during printing.

In contrast thereto, according to the print head 100''' of the present embodiment, a gap between projections does not exist, which thus allows preventing ink from dropping on a print medium during printing to stain the print medium by preventing ink from pooling between the projections. This also allows preventing ink pooled in a gap between projections from firmly fixing to remain as a foreign substance, or dust from depositing in a gap between projections. Additionally, as compared to providing two rows of minute projections between ejection port rows, the configuration of the present embodiment where a projection plate to form projections is arranged on an orifice plate facilitates manufacturing of a print head.

Fourth Embodiment

Next, a fourth embodiment for carrying out the present invention will be described. A description of the same part of configuration as that of the first to third embodiments mentioned above will be omitted, and only a different part will be described.

Figure 15:
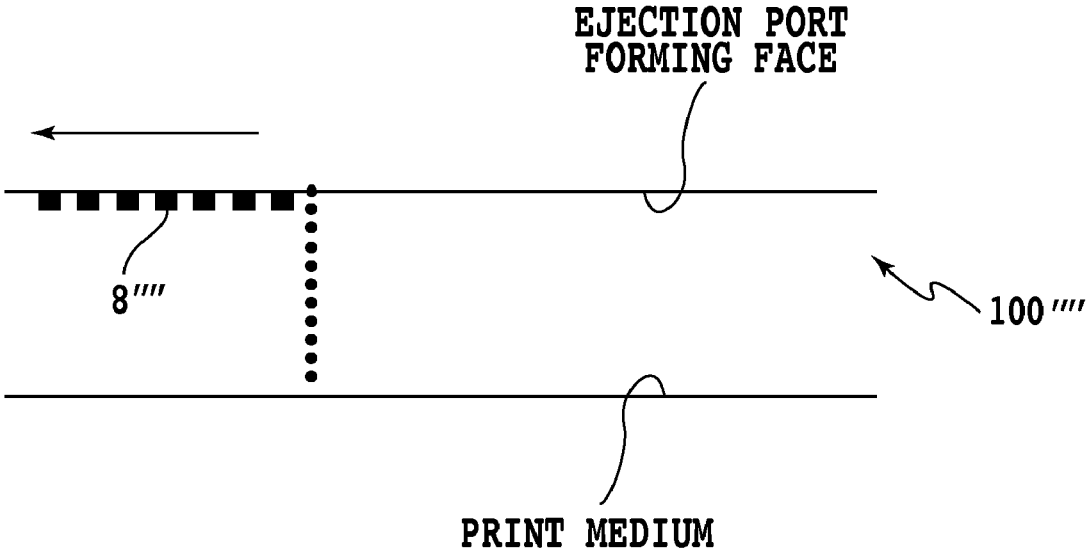
FIG. 15 is a side view of a print head according to a fourth embodiment of the present invention, in which a projection is arranged only at the front in a scanning direction of an ejection port.
Figure 16:
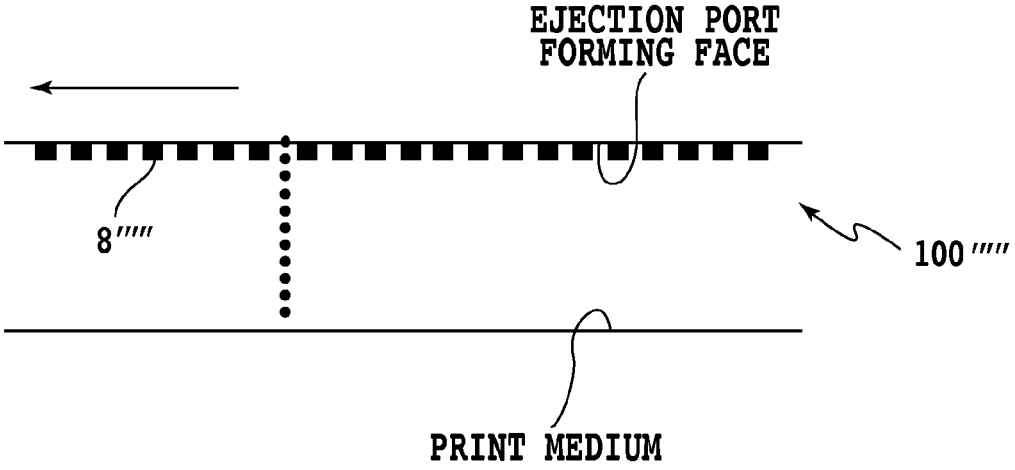
FIG. 16 is a side view of a print head according to a fourth embodiment of the present invention, in which a projection is arranged at both the front and rear in a scanning direction of an ejection port.

FIGS. 15 and 16 are side view of a print head 100'''' and a print head 100''''' of the fourth embodiment. The print head 100'''' shown in FIG. 15 is arranged with a projection only at the front in a scanning direction of an ejection port 1, and a printhead 100''''' shown in FIG. 16 is arranged with a projection at both the front and rear in a scanning direction of an ejection port 1. In terms of these points, the present embodiment has the same configuration as that of the foregoing embodiments. However, a plurality of projections 8'''' are arranged at the front in the scanning direction for one ejection port row 2 in the print head 100'''' of FIG. 15. Moreover, in the print head 100''''' of FIG. 16, a plurality of projections 8''''' are arranged at the front and rear in the scanning direction for one ejection port row 2. In these points, the print head of the present embodiment is different from the embodiments described above. In addition, the plurality of projections 8'''' of FIG. 15 and the plurality of projections 8''''' of FIG. 16 are formed with relatively narrow intervals.

The print head of the present embodiment is formed with relative narrow intervals between the plurality of projections as such, and thus can retain ink between the projections by a capillary force. This allows increasing the humidity in the vicinity of the ejection port, to prevent an increase in the viscosity of ink in the ejection port due to drying. Thus, on a ejection port forming face of the print head, such a situation as not to be able to ejection ink from a ejection port due to an increase in the viscosity of ink can be prevented from occurring.

Fifth Embodiment

Next, a fifth embodiment for carrying out the present invention will be described. A description of the same part of configuration as that of the first to fourth embodiments mentioned above will be omitted, and only a different part will be described.

Figure 17:
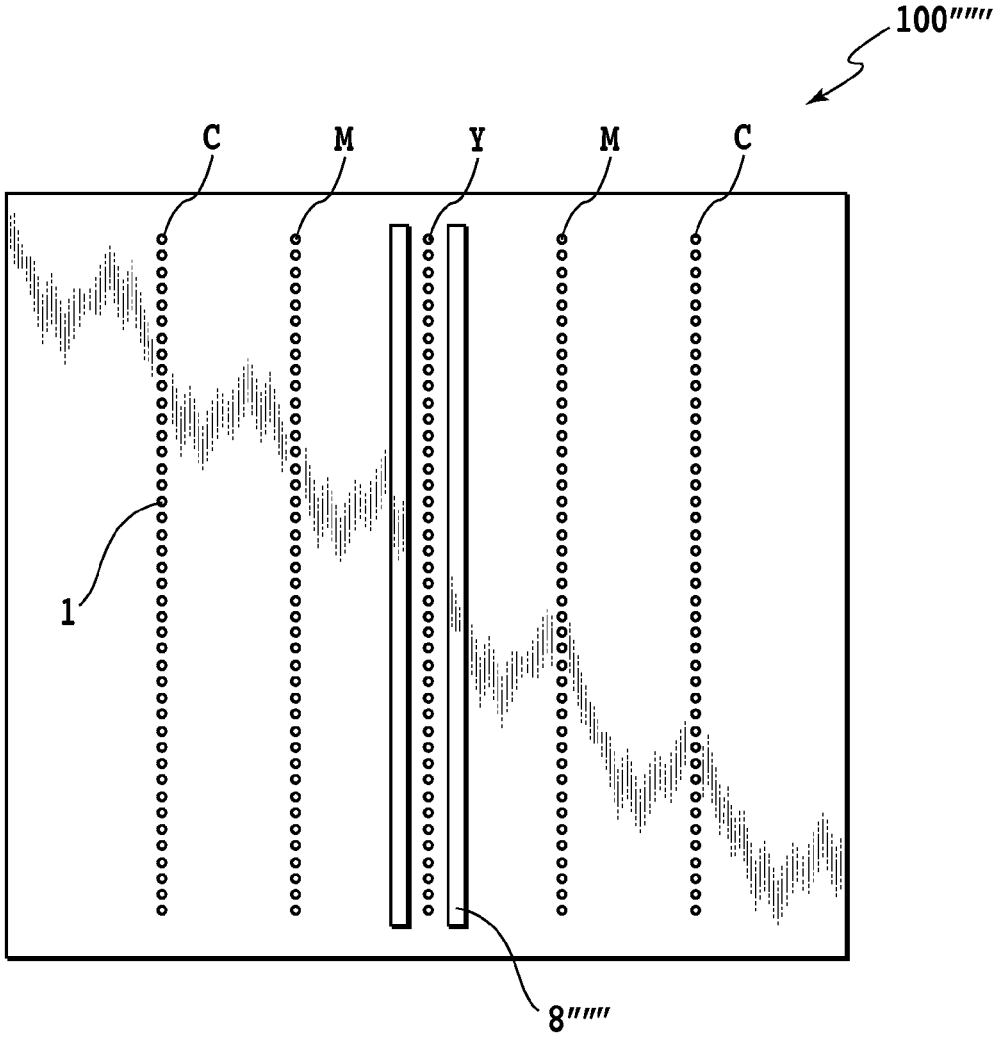
FIG. 17 is a plan view of a print head according to a fifth embodiment of the present invention.
Figure 18:
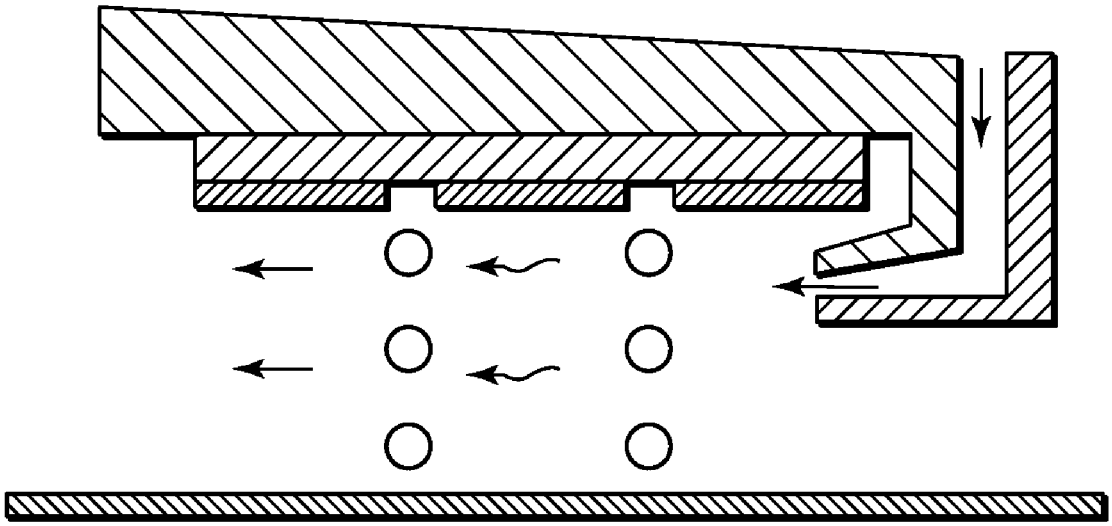
FIG. 18 is a sectional view schematically showing an example of a conventional print head.
Figure 19A:
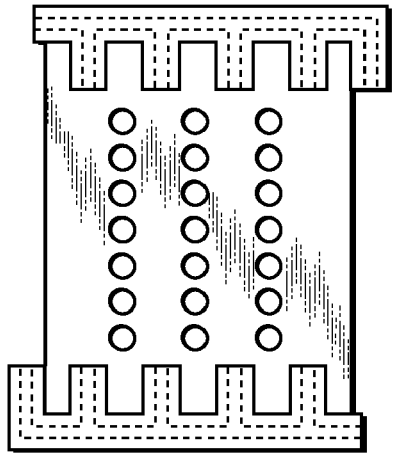
FIG. 19A is a plan view showing an ejection port forming face of another conventional print head.
Figure 19B:
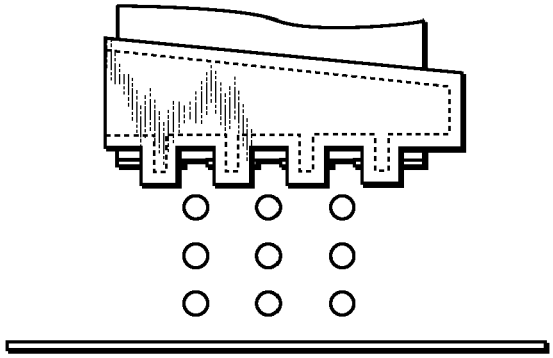
FIG. 19B is a side view showing an ejection port forming face of another conventional print head.
Figure 19C:
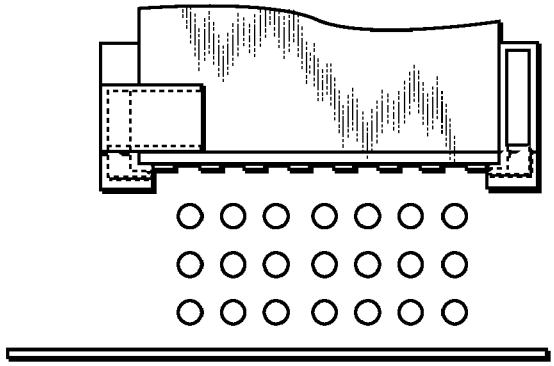
FIG. 19C is a front view showing an ejection port forming face of another conventional print head.

A print head 100''''' shown in FIG. 17 is arranged with ejection port rows in an order of cyan (C), magenta (M), yellow (Y), magenta (M), and cyan (C) so as to respond to two-way printing. Here, with respect to the ejection port row arranged at there only one such as yellow, the ejection port row has a larger amount of ink ejection per one ejection port than that of the ejection port row of another color that exists double. Moreover, yellow ink is ejected at a higher ejection frequency than that of ejection of another color in most cases. With a larger ejection amount or a higher ejection frequency as with yellow in this case, a vortex to be generated by flying of ink is more intense than that to be generated by a ejection of another color of ink. At this time, when an ink ejection is performed in vicinity of the ejection port row that generates an intense vortex, there is a case that, particularly, small droplets are carried away by the intense vortex generated by ejection from the ejection port row, such as yellow, and the impacting position is greatly misaligned, so that the image quality significantly deteriorates.

In such a case, particularly, it is important to suppress an intense vortex due to the ink ejection amount being large and the ejection frequency being high. Therefore, it is effective, in such a head as in FIG. 17, to provide a projection 8''''' in the vicinity of the ejection port row of yellow for preventing misalignment in the impacting position of not only the yellow ink but also the neighboring magenta ink. The projection to be provided in the vicinity of the ejection port row of yellow may be provided either in only a head forward direction (direction opposite to a print medium conveying direction if the head position is fixed) or at both sides so as to sandwich the ejection port row therebetween as shown in FIG. 17.

In addition, when the projection is formed for only the yellow ejection port row as such, because of a smaller number of obstacles to a wiper in the case of wiping of the face, wiping can be easily performed, and such an arrangement is also preferable in that the wiper can have a prolonged life.

Although an example of providing the projection only in the vicinity of the ejection port row of yellow is described in the present embodiment, the present invention is not limited thereto. It is preferable, in a print head in which a plurality of ejection port rows are formed, to provide a projection for an ejection port row of the largest ejection amount or an ejection port row of the highest ejection frequency.

Sixth Embodiment

Next, a sixth embodiment for carrying out the present invention will be described. A description of the same part of configuration as that of the first to fifth embodiments mentioned above will be omitted, and only a different part will be described.

There are two main methods for providing a projection in the vicinity of an ejection port row: providing a projection portion by lamination; and preparing a projection member separately, and bonding the projection member to a chip surface. When a projection member is bonded to the ejection port forming face of an orifice plate, it is necessary to bond the projection member with accuracy. This is because unevenness in the distance between the ejection port and the projection within a single ejection port row causes a difference in the effect of suppressing the deflection due to an air flow, and uneven distribution also occurs in the deflection of the impacting position.

In this case, bonding respective projection members for a plurality of ejection port rows with accuracy requires high manufacturing cost and a long manufacturing time. It is therefore preferable to manufacture a member that integrates all projection members, and bond the integrated projection member to the ejection port forming face. This also improves positional accuracy, which is thus advantageous in terms of manufacturing cost, manufacturing time, and reliability. Moreover, the integrated projection member can be easily manufactured with accuracy by drilling a single plate member at apart corresponding to the ejection port rows with a laser or the like.

Other Embodiments

Also, a liquid ejection head of the present invention can be mounted on an apparatus such as a printer, a copying machine, a facsimile machine including a communication system, or a word processor including a printer unit, or an industrial printing apparatus combined with various processing devices in a complex manner. And, using this liquid ejection head allows performing printing on various print media such as paper, a thread, a fiber, cloth, leather, a metal, plastic, glass, wood, and ceramic. The term "printing" used herein means to form not only an image that carries a meaning, such as a character or a graphic, but also an image that carries no meaning, such as a pattern, on a print medium.

Further, "ink" or "liquid" should be widely construed, and refer to a liquid to be used, by being applied onto a print medium, for forming an image, a design, or a pattern, or processing ink or a print medium. Here, the processing of ink or a print medium means, for example, improvement in fixation by coagulation or insolubilization of a coloring material in ink applied to the print medium, improvement in printing quality or color development, or improvement in image durability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-323735, filed Dec. 19, 2008, and 2009-256144, filed Nov. 9, 2009, which are hereby incorporated by reference herein in their entirety.

What is claimed is:

1. A liquid ejection head comprising:

an ejection port array formed by a plurality of ejection ports, for ejecting liquid, arranged in a row; and a projection projecting from an ejection port forming face where the ejection ports are formed, the projection being formed along the ejection port array, wherein the projection is arranged at a position where a distance from the ejection port array is within a maximum of a diameter of a vortex core of a vortex that is formed when liquid droplets are ejected in a case without the projection, and wherein the projection is not formed between the plurality of ejection ports.

2. The liquid ejection head according to claim 1, wherein the plurality of the ejection ports are arranged in a row, and the projection extends along the row.

3. The liquid ejection head according to claim 2, wherein the projection discontinuously extends along the row.

4. The liquid ejection head according to claim 2, wherein the projection has a length in a direction along the row longer than that of the row.

5. The liquid ejection head according to claim 4, wherein the projection has a length in a direction along the row longer than that of the row by 1 mm or more.

6. The liquid ejection head according to claim 1, wherein the liquid ejection head is relatively movable with respect to a print medium, and the projection is arranged in front of the ejection port array relative to a moving direction with respect to a print medium.

7. The liquid ejection head according to claim 1, wherein the liquid ejection head is relatively movable with respect to a print medium, and the projection is arranged in front of and behind the ejection port array relative to a moving direction with respect to a print medium.

8. The liquid ejection head according to claim 1, wherein the projection is arranged at a position of less than 600 μm from a center of each of the ejection ports.

9. The liquid ejection head according to claim 8, wherein the projection is arranged at a position within 400 μm from a center of each of the ejection ports.

10. The liquid ejection head according to claim 9, wherein the projection is arranged at a position within 200 μm from a center of each of the ejection ports.

11. The liquid ejection head according to claim 1, wherein the projection has a height of 20 μm or more.

12. The liquid ejection head according to claim 11, wherein the projection has a height of 50 μm or more.

13. The liquid ejection head according to claim 12, wherein the projection has a height of 200 μm or more.

14. The liquid ejection head according to claim 1, wherein the plurality of the ejection ports are arranged in a row, and the projection has a length of 42 μm or more in a direction perpendicular to the row.

15. The liquid ejection head according to claim 1, comprising a plurality of ejection port rows, in each of which a plurality of the ejection ports are arranged, wherein the projection is formed only for an ejection port row, of the plurality of ejection port rows, that ejects a greatest amount of the liquid.

16. The liquid ejection head according to claim 1, comprising a plurality of ejection port rows, in each of which a plurality of the ejection ports are arranged, wherein the projection is formed only for an ejection port row, of the plurality of ejection port rows, that ejects a liquid at a highest frequency.

17. The liquid ejection head according to claim 1, wherein the projection is formed in plurality, and the plurality of projections are formed integrally of a single member.

18. A printing apparatus including a carriage that can be mounted with the liquid ejection head according to claim 1.

19. The liquid ejection head according to claim 1, wherein the projection is arranged at a position where a distance from a center of each of the ejection ports is within the maximum of the diameter of the vortex core of the vortex that is formed when liquid droplets are ejected in the case without the projection.

* * * * *